US008484928B2

(12) United States Patent
Müller

(10) Patent No.: US 8,484,928 B2
(45) Date of Patent: Jul. 16, 2013

(54) METHOD FOR PRODUCING A WALL-CEILING REINFORCED CONCRETE CONSTRUCTION

(75) Inventor: Michael Müller, Hennersdorf (AT)

(73) Assignee: VST Verbundschalungstechnik AG, Hennersdorf (AT)

( * ) Notice: Subject to any disclaimer, the term of this patent is extended or adjusted under 35 U.S.C. 154(b) by 852 days.

(21) Appl. No.: 11/996,884

(22) PCT Filed: Jul. 28, 2005

(86) PCT No.: PCT/EP2005/008220
§ 371 (c)(1),
(2), (4) Date: Jun. 30, 2008

(87) PCT Pub. No.: WO2007/012345
PCT Pub. Date: Feb. 1, 2007

(65) Prior Publication Data
US 2008/0302057 A1 Dec. 11, 2008

(51) Int. Cl.
*E04B 1/00* (2006.01)

(52) U.S. Cl.
USPC ..... 52/742.14; 52/251; 52/414; 52/236.6; 264/35

(58) Field of Classification Search
USPC ..... 52/742.14, 425, 426, 431, 432, 565, 52/309.12, 251, 272, 236.5, 236.6, 260, 414, 52/434, 699; 264/35
See application file for complete search history.

(56) References Cited

U.S. PATENT DOCUMENTS

| | | | | |
|---|---|---|---|---|
| 1,031,048 | A * | 7/1912 | Conzelman | 52/283 |
| 2,043,697 | A * | 6/1936 | Deichmann | 52/372 |
| 2,569,669 | A * | 10/1951 | Henderson | 52/283 |
| 2,903,880 | A * | 9/1959 | Johnson | 52/454 |

(Continued)

FOREIGN PATENT DOCUMENTS

| | | |
|---|---|---|
| DE | 298 05 829 U1 | 8/1998 |
| EP | 0 611 852 B1 | 8/1994 |

(Continued)

OTHER PUBLICATIONS

English Translation of EP 1046758 A1 (Bless et al.), translated Feb. 2013 by Schreiber Translations, Inc.*

(Continued)

*Primary Examiner* — Robert Canfield
*Assistant Examiner* — Charissa Ahmad
(74) *Attorney, Agent, or Firm* — Finnegan, Henderson, Farabow, Garrett & Dunner LLP

(57) ABSTRACT

Method of producing a wall-floor reinforced concrete construction in which use is made of prefabricated permanent shuttering systems made up of a wall shuttering system (100) with two shuttering panels (101; 103) and a floor shuttering system (120) which comprises a base plate (123) with a multiplicity of individual longitudinal bars (121) next to one another which are each fastened by means of a multiplicity of stirrups (122) on the base plate (123) at a distance above the base plate in such a way that they come to lie in the lower region of the floor (171) to be produced. The connecting element between the wall and floor that is used is a coupling reinforcement (150) which, on one side, is fastened into the wall shuttering system (100) and, on the other side, to the individual longitudinal bars (121) of the floor shuttering system (120) which extend perpendicularly to the wall shuttering system (100).

4 Claims, 2 Drawing Sheets

U.S. PATENT DOCUMENTS

Figure 1:
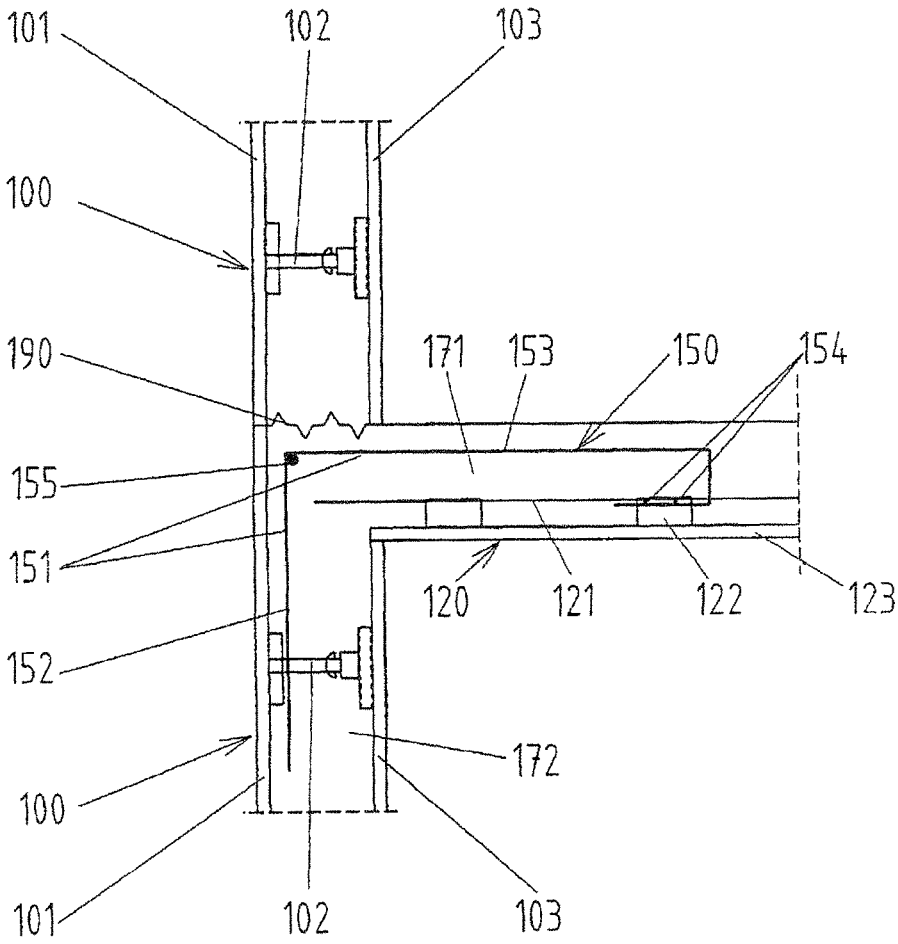

| | | | | | |
|---|---|---|---|---|---|
| 3,315,424 | A | * | 4/1967 | Smith | 52/206 |
| 3,399,505 | A | * | 9/1968 | Comment | 52/742.14 |
| 3,662,506 | A | * | 5/1972 | Dillon | 52/251 |
| 3,846,952 | A | * | 11/1974 | De Winter | 52/742.14 |
| 3,961,457 | A | * | 6/1976 | Zalewski | 52/742.14 |
| 4,081,935 | A | | 4/1978 | Wise | |
| 4,128,980 | A | * | 12/1978 | Abdallah | 52/251 |
| 4,147,009 | A | * | 4/1979 | Watry | 52/742.15 |
| 4,211,045 | A | * | 7/1980 | Koizumi et al. | 52/251 |
| 4,226,061 | A | * | 10/1980 | Day, Jr. | 52/125.2 |
| 4,409,764 | A | * | 10/1983 | Wilnau | 52/127.3 |
| 4,472,331 | A | * | 9/1984 | Kida | 264/31 |
| 4,648,228 | A | * | 3/1987 | Kiselewski | 52/426 |
| 5,117,600 | A | * | 6/1992 | Yerushalmi | 52/262 |
| 5,181,359 | A | * | 1/1993 | Chana et al. | 52/253 |
| 5,392,580 | A | * | 2/1995 | Baumann | 52/660 |
| 5,428,932 | A | | 7/1995 | Gruber | |
| 5,682,717 | A | * | 11/1997 | Carranza-Aubry | 52/251 |
| 5,878,541 | A | | 3/1999 | Gruber | |
| 6,003,281 | A | * | 12/1999 | Pilakoutas | 52/742.14 |
| 6,385,930 | B1 | * | 5/2002 | Broms et al. | 52/251 |
| 6,948,289 | B2 | * | 9/2005 | Bravinski | 52/415 |
| 7,661,231 | B2 | * | 2/2010 | Dalton | 52/236.8 |
| 7,856,778 | B2 | * | 12/2010 | Pantelides et al. | 52/309.1 |
| 2001/0003234 | A1 | * | 6/2001 | Van Doren | 52/251 |
| 2002/0046524 | A1 | * | 4/2002 | Li et al. | 52/393 |
| 2002/0100247 | A1 | * | 8/2002 | Lai | 52/742.14 |
| 2004/0237439 | A1 | * | 12/2004 | Powell | 52/505 |

FOREIGN PATENT DOCUMENTS

| | | | | |
|---|---|---|---|---|
| EP | 0 811 731 | B1 | | 12/1997 |
| EP | 1 046 758 | A1 | | 10/2000 |
| EP | 1 243 712 | A2 | | 9/2002 |
| FR | 2 677 393 | | | 12/1992 |
| JP | 01203545 | A | * | 8/1989 |
| JP | 03132532 | A | * | 6/1991 |
| JP | 04140365 | A | * | 5/1992 |
| JP | 04247124 | A | * | 9/1992 |
| JP | 06088428 | A | * | 3/1994 |
| JP | 06136881 | A | * | 5/1994 |
| JP | 06193196 | A | * | 7/1994 |

OTHER PUBLICATIONS

English translation of portions of EP Patent 1046758 A1, 2 pages.

* cited by examiner

METHOD FOR PRODUCING A WALL-CEILING REINFORCED CONCRETE CONSTRUCTION

The invention relates to a method for producing a wall-ceiling reinforced concrete construction, use being made of prefabricated permanent formwork systems made up of a wall formwork system and a ceiling formwork system.

When producing a conventional wall-ceiling reinforced concrete construction on an end support, usually a conventional wall formwork is first provided with the required static, constructional and required connection reinforcement and grouted with in-situ concrete. Once the concrete has reached a specific concrete strength, the fitting of the reinforced concrete ceiling formwork can commence. This can, in particular, lead to problems in the region of the end support which is statically defined as being freely rotatable but experiences partial fixing if, for example, a second wall is erected above the end support. Once the second wall has been constructed, there occurs at this location, according to static theory, a tensile moment which has to be transferred using an appropriate reinforcement. Internationally or nationally valid standards can be consulted to determine the required reinforcement.

For example, DIN 1045, 20.1.6.2.(2) stipulates that in the above-mentioned case, a specific component of a calculated, static reinforcement is additionally to be introduced on the end support. A reinforcement of this type on the end support protrudes into the ceiling region and has a disruptive effect in the further building measures and also risks injuring the builders working on site, especially when the formwork for the reinforced concrete ceiling panels and their required static and constructional reinforcement is laid. If the reinforcement bars protrude too far into the ceiling region, it may be necessary, for inserting the transfer table, for the reinforcement bars to be bent back, so the transfer table can be inserted. Such bending requires additional operations and can have drawbacks.

However, the facilities available on site hardly allow a bent bar to be fully straightened again when cold. A reinforcement bar which has been bent back and forth when cold still has an S-shaped double curvature. The forces of deflection caused by the double curvature produce tensile stress in the concrete, and this can lead to cracks.

In addition, it may be necessary, if the required reinforcement intersects the formwork, for the formwork to be spot-drilled at the intersection in order to carry out the bar reinforcement or a complex butt joint, such as for example a bell butt joint, has to be provided for the bar reinforcement subsequently to be connected.

Furthermore, in building practice, the problem frequently occurs that a wall-ceiling construction has to be formed, for example, in the midspan of the ceiling panel, the load-transferring walls being arranged, depending on use, not one above another but rather offset with respect to one another. In this case, a load-transferring wall ends in one storey without the loads which occur being transferred to the associated foundation by a load-transferring wall arranged therebelow, a strut or a joist or the like. This may, for example, be the case if each storey has a different use (for example, a hotel: on the top storey rooms are provided, on the storey therebelow the restaurant is provided so as to have as few struts as possible). The ceiling, which has no support at this location, is intended to transfer the loads from the top storeys and the ceiling located below the wall and also the inherent loads are imposed loads acting thereon, and this can be statically and economically problematic, especially if the struts are positioned far apart from one another.

Another prior-art problem is that the use of normal concrete at the butt joints of conventional formwork systems can lead to the bleeding of laitances of the unset concrete. In order to prevent this, a seal has to be formed in conventional, reusable formwork systems and appropriate release agent have to be applied to the surface of a reusable formwork system in order to allow the formwork to be detached from the set concrete without damaging the surface of the concrete and the surface of the formwork. Damage to the surface of the concrete or bleeding is unattractive, specifically in the case of exposed concrete, and can necessitate curing.

In addition, in the case of conventional formwork systems, problems can occur if the concrete has to be compacted while still in a liquid state. Internal vibrators are conventionally used to ensure filling of all cavities and deaeration during the introduction of normal concrete in the formwork. The use of an internal vibrator produces noise and vibrations, and this can have an adverse effect on the operator of the internal vibrator, who holds the internal vibrator and lowers it into the liquid concrete, and the immediate environment and the building.

In addition to the loading of the operating forces, mishandling of internal vibrators can also damage the formwork considerably. The formwork shell is, in particular, affected in the event of direct contact with the internal vibrator.

Direct contact of the internal vibrator with the reinforcement can also lead to problems such as, for example, at the intersection of the reinforcement with the liquid concrete, the vibration of the reinforcement, which is produced by the contact of the internal vibrator with the reinforcement, causing the gravel aggregate to fall away from the reinforcement and increasing the cement paste content at this location. Here there is no gravel aggregate "support structure" which, when the concrete has set, is intended to transfer compressive forces which can occur during the transmission of force between the concrete and the reinforcement.

EP 0 611 852 B1 discloses a composite formwork system for forming a wall, which system is used in accordance with the principle of a permanent formwork and which wall is suitable for the method according to the invention of a wall-ceiling construction.

EP 0 811 731 B1 discloses a formwork system for forming a ceiling, which system is used in accordance with the principle of a permanent formwork and which wall is suitable for the method according to the invention of a wall-ceiling construction.

An object of the invention is to provide a method for producing a wall-ceiling construction in particular at the wall-ceiling joint.

According to the invention, two formwork systems are combined to erect the wall and ceiling. The wall formwork system comprises two formwork panels which are held apart from each other and secured to each other by means of coupling devices. The ceiling formwork system, which is configured without lattice girders, comprises a base panel to which there are anchored a plurality of parallel longitudinal bars which come to lie in the lower third of the ceiling to be produced. Both formwork systems are joined together in such a way that the longitudinal bars of the ceiling formwork system extend perpendicularly to the wall formwork system. As a point of transition from the wall to the ceiling, a connection reinforcement is inserted into the two formwork systems in such a way that it is anchored to the individual longitudinal bars of the ceiling formwork system and thus also directly to the base panel.

The method according to the invention allows the wall and the ceilings to be fitted together and concreted in one piece in the region of an end support of the ceiling without bending of the reinforcement, spot-drilling of the formwork or complex butt joints being required. The method according to the invention combines, in particular, the advantages of the wall composite formwork system according to EP 0 611 852 B1, of being able rapidly to produce extensive wall discs, with the advantages of the ceiling formwork system according to EP 0 811 731 B1, which system can perform supporting functions both during production of the ceiling prior to concreting and when the ceiling panel has been completed.

During the formation of an end support, in which partial fixing is expected to be caused by the constructional and/or static problems which occur, the method according to the invention provides an inexpensive and simple response to this partial fixing. The method according to the invention allows the required constructional and/or static reinforcement on the end support, which experiences partial fixing, to be inserted, starting from the upper side of the ceiling formwork system, into the already erected wall formwork system and the ceiling formwork system. Once the wall formwork system has been erected, the ceiling formwork system can be erected immediately without any reinforcement bars causing an obstruction, such as usually occurs in the case of concrete wall discs produced in the conventional manner with a reusable formwork, or without having to wait for the concrete poured into the wall formwork first to reach sufficient strength in order to be able to commence with the construction of the ceiling panel.

It is particularly advantageous for assembly of the ceiling formwork system that the necessary reinforcement for transferring the moment resulting from the partial fixing does not reach, during erection of the ceiling formwork system, into the ceiling region and therefore does not have to be bent back, as this top reinforcement is introduced only once both the wall formwork system and the ceiling formwork system have been erected. The top reinforcement is secured using suitable securing elements, on one side, to the wall formwork system and, on the other side, to the individual bar reinforcement, which is already provided, of the ceiling formwork system, the individual longitudinal bars of the ceiling formwork system protruding with the required securing length into the wall formwork system on the end support. Once the static and constructive reinforcement, which is necessary in addition to the top reinforcement, has been introduced into the formwork systems, the wall formwork system and the ceiling formwork system can then be grouted with concrete in one course.

If it is desirable to form on the end support with the wall formwork system a construction joint between the upper edge of the concrete wall and the lower edge of the concrete ceiling, wall formwork panels having uniform dimensions are used on the end support, both the inner formwork panel facing the ceiling and the formwork panel remote from the ceiling ending in the level of the base panel of the ceiling formwork system or of the lower edge of the concrete ceiling. However, cement paste can issue from this construction joint during concreting of the concrete ceiling and thus impair the visual impression.

In order to prevent the formation of a construction joint between the concrete wall and the concrete ceiling on the lower edge of the ceiling, the wall and the ceiling should be concreted without a timely interruption. For this purpose, the outer formwork panel can be extended by the distance from the upper edge of the outer formwork panel to the upper edge of the finished concrete ceiling using additional formwork panels. However, the outer formwork panel of the wall formwork system for an end support may already be configured in such a way that it is higher than the inner formwork panel by the thickness of the concrete ceiling, and this avoids additional formwork operations on site, thus promoting concreting in one course and avoiding the formation of a construction joint between the wall and the lower edge of the ceiling.

In the case of an end support, the partial fixing on the end support on the upper side of the ceiling panel produces tensile stress to be transferred by a tensile reinforcement, referred to in the present document as a top reinforcement. In the case of end supports which are subject to partial fixing, the method according to the invention provides a more effective response to the static and mechanical situation or to the reactive forces (supporting moment).

Compared to a reinforced concrete ceiling panel in which the end supports are calculated and defined so as to be able to rotate freely, the deflection of the reinforced concrete ceiling panel, produced using the method according to the invention, is significantly improved owing to the corner piece-like configuration of the end supports. The required panel thickness is conventionally calculated from the limitation of the deflection of the panel. As a result of the relatively low deflection of the panel, the panel thickness can as a whole be designed so as to be thinner, and therefore less expensive, compared to reinforced concrete ceiling panels having freely rotatable end supports, the deflection otherwise remaining constant.

The fact that the top reinforcement is, in the method according to the invention, laid only once the ceiling formwork system and the wall formwork system have been erected means that the reinforcement does not have to be guided so carefully as, for example, it is not necessary to bend the reinforcement upward in order to introduce the transfer table of the ceiling formwork system.

The method according to the invention improves the vertical bond between the reinforced concrete ceiling panel and the wall disc, as the top reinforcement, which is secured to the individual longitudinal bars of the ceiling formwork system, can be introduced in a simple manner and with sufficient securing length, on one side, into the wall formwork system and, on the other side, into the ceiling formwork system.

The method according to the invention can also be used for producing a wall disc bendable girder for a suspended ceiling. As the individual longitudinal bars of the ceiling formwork system perform supporting functions both during the production of the panels and in the finished reinforced concrete ceiling panel and are thus taken into account statically, the suspension reinforcement necessary for suspending the ceiling panel from a wall disc bendable girder can be secured in a simple manner, using reliable securing elements, to the individual longitudinal bars of the ceiling formwork system. Once the reinforced concrete ceiling panel has been filled with concrete and has set, the wall composite formwork is connected to the suspension reinforcement in a simple manner. The wall formwork system is provided in advance at the factory with the static and constructional reinforcement, in the form of mats and round steel bars, required to form the wall disc bendable girder.

Self-compacting concrete (SCC) is a particularly suitable concrete for the method for producing a wall-ceiling reinforced concrete construction for concreting both of the above-described wall-ceiling formwork systems. SCC is normal concrete which fills all cavities on introduction into the formwork, simply by virtue of gravity, and deaerates independently, without the use of concrete compacting devices (for example, internal vibrators). The application of compacting energy for the purposes of deaerating is therefore not necessary on introduction of SCC. The staff necessary for compacting and the devices necessary for compacting can be spared, and noise and vibrations which otherwise occur when concrete compacting devices are used are avoided.

The use of SCC eliminates errors such as damage to the formwork caused by mishandling of internal vibrators and direct contact with the reinforcement. As a result of the cohesive properties of SCC, there are generally no problems with bleeding of the unset concrete. This reduces any repair work. In contrast to vibrated concrete, the deaeration of which is promoted by the vibration of the vibrator, SCC deaerates as a result of flowing of the concrete without the influence of external energy.

Building site observations have revealed that, in the case of a flow path of 3-5 m within the component, the concrete product has almost no holes. The introduction of SCC both into vertical components such as walls and struts and, in particular, in horizontal two-dimensional components such as ceilings is simplified by its self-levelling properties, i.e. SCC offers demixing-free outflow until the levels have been fully equalized.

Figure 2:
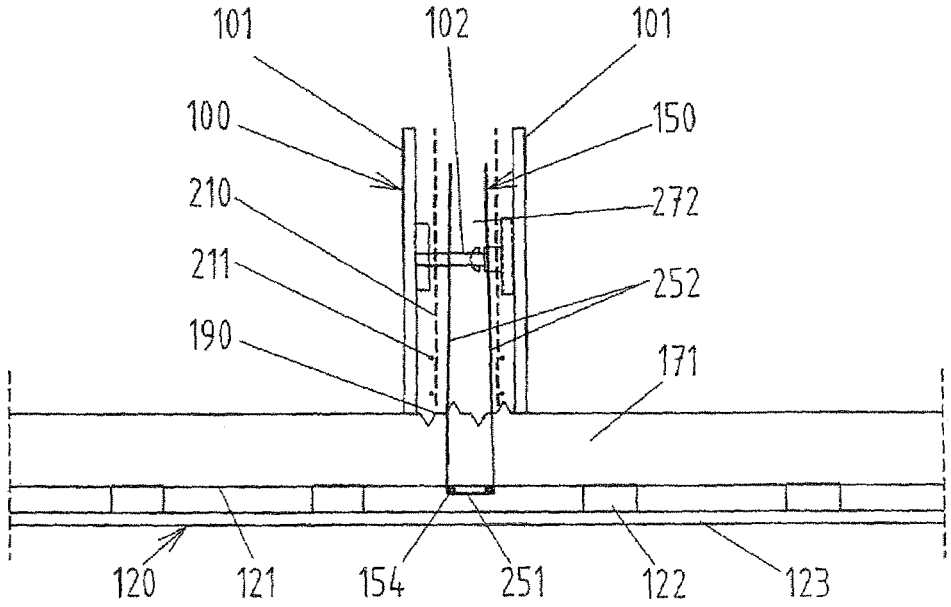

The invention will be described hereinafter based on preferred exemplary embodiments and with reference to the drawings, in which:

FIG. 1 is a cross section of a simplified reinforcement plan as a first exemplary embodiment of the method according to the invention for forming a wall-ceiling construction with a wall formwork system and a ceiling formwork system; and FIG. 2 is a cross section of a simplified reinforcement plan of a second embodiment of the method according to the invention for forming a wall disc bendable girder for a suspended ceiling with the wall formwork system and the ceiling formwork system.

FIG. 1 is a cross section of a reinforcement plan as a wall-ceiling construction on an end support of a multi-storey building, which construction is produced using the method according to the invention, use being made of prefabricated permanent formwork systems comprising a ceiling formwork system 120 and a wall formwork system 100.

The wall formwork system 100 from FIG. 1 can, for example, be configured in accordance with EP 0 611 852 B1 and comprises two formwork panels, namely an outer formwork panel 101 remote from the ceiling and an inner formwork panel 103 facing the ceiling, which formwork panels are set apart from each other and are joined together by coupling devices 102. The wall formwork system according to EP 0 611 852 A1 is particularly suitable for the method for producing a wall-ceiling reinforced concrete construction, as the wall formwork system allows extensive formwork walls to be produced in a simple manner. In order to produce the wall formwork, the lateral abutment edges (not shown) of the formwork panels of the wall formwork system are butt-jointed. The abutment edges are oriented parallel to one another on the longitudinal sides of the formwork panel, the formwork panel being configured on one abutment edge with lock-in projections (not shown) and on the other abutment edge with lock-in recesses (not shown) for joining the formwork panels in the longitudinal direction of the formwork wall. The lock-in recesses and lock-in projections are configured in such a way that the lock-in projections of a second formwork panel to be attached to an erected first formwork panel are configured in such a way that those lock-in projections of the second formwork panel fit into the lock-in recesses in the first formwork panel, thus allowing very rapid assembly of one wall side of an extensive formwork wall. The formwork panels of the other wall side are joined together with spacing via the coupling device 102 in the transverse direction of the formwork wall.

The ceiling formwork system 120, which does not have any lattice girders, is preferably configured in accordance with EP 0 811 731 B1 and comprises a base panel 123, a plurality of individual longitudinal bars 121 arranged parallel next to one another and a plurality of stirrups 122. The stirrups 122 are arranged in a plurality of parallel series, distributed over the base panel 123, and are, in particular, configured so as to be U-shaped with leg panels pointing toward the base panel 123 and a web panel extending at a distance above the base panel 123 and parallel thereto. The leg panels can be provided at their free ends with flange panels which are at an angle of 90° from the leg panels and on which the stirrups 122 are secured to the base panel 123, for example by means of screws. The individual longitudinal bars 121 are welded in the corners between the web panel and the leg panels of the stirrups 122, the height of which is such that the individual longitudinal bars 121 come to lie, once the concrete has been applied, in the lower region of a finished concrete ceiling 171, in particular in the lower third of the thickness of the concrete ceiling. Additional lattice girders are not provided in the concrete ceiling 171.

Once the concrete ceiling has set, the individual longitudinal bars 121 are therefore subjected to tensile stress, so they can transfer the tensile forces. During construction, on the other hand, the individual longitudinal bars 121 can also be considered statically before and during the pouring of the concrete, and this reduces the number of necessary support devices and the time required for the fitting and removal thereof, because the individual longitudinal bars 121 transmit pressure before the pouring of the concrete and up to the setting of the concrete layer, whereas the base panel 123 transmits tensile force.

Firstly, the wall composite formwork system 100 is erected and protected, using a suitable temporarily erected support device (not shown), from the concrete pressure which occurs during pouring of liquid concrete, wherein the required constructional and static reinforcement (not shown) of the wall 172 to be concreted can be laid with the formwork walls. Then, in contrast to the prior-art method, the ceiling formwork system 120 is attached to the wall formwork system 100, so that the individual longitudinal bars 121 of the ceiling formwork system 120 extend perpendicularly to the wall formwork system 100 and are secured and sealed, using suitable means, to the inner formwork wall 103 of the wall formwork system so as to prevent concrete or cement paste from being able to issue before the wall formwork system 100 is grouted with concrete. The individual longitudinal bars of the ceiling formwork system 120 can be configured so as to protrude on the end support into the wall formwork system with the required securing length, i.e. at least to beyond the theoretical support line. The required securing length of the individual longitudinal bars can be provided both in the case of direct and in the case of indirect mounting of the ceiling formwork system on the end support.

In the embodiment shown in FIG. 1, the inner formwork panel 103, which is adjacent to the ceiling 171, of the wall formwork system 100 is lower by the thickness of the finished ceiling 171 than the formwork panel 101 remote from the ceiling, the base panel 123 of the ceiling formwork system 120 being placed flush, inwardly toward the wall, on the inner formwork panel 103.

If the two formwork systems 100, 120 are protected, using suitable support devices, from the concrete pressure and from the loads which otherwise occur and the additional reinforcement, which is additionally provided in the ceiling 171, has been inserted and secured, there is inserted on the end support for each successive meter a connection reinforcement 150 which is connected using suitable securing means, on one side, to the wall formwork system 100 and, on the other side, to the ceiling formwork system 120.

The connection reinforcement 150 on the end support comprises an angular top reinforcement 151 and, in particular, also a distributing reinforcement 155, for example in the form of round steel bars, at the angular peak of the top reinforcement 151. The one, first leg 152 of the top reinforcement 151 is inserted between the formwork panels 101, 103 of the wall formwork system 100, so that the distributing reinforcement 155 is also arranged in the wall formwork system, and the other, second leg 153 comes to lie in the upper region of the ceiling 171 to be completed. The second leg 153, which protrudes into the ceiling 171, of the top reinforcement 151 is suspended by means of a constructional securing element 154 below the individual longitudinal bars 121 and/or their stirrups 122 for securing the ceiling formwork system 120, and this has a positive effect, inter alia, on the necessary anchoring length of the top reinforcement 151 in the concrete ceiling 171. The anchoring length can thus be shortened, and this entails a smaller amount of steel.

Once the top reinforcement 151 has been inserted from above, the wall formwork system 100 can be grouted with concrete, together with the ceiling formwork system. The concrete used may be any suitable concrete, self-compacting concrete being especially suitable in the present method. The use of self-compacting concrete means that the liquid concrete does not have to be compacted using internal vibrators and deaerated, and this in turn spares additional operations. If an additional storey is provided as shown in FIG. 1, the ceiling-wall formwork system is in a similar manner constructed, as described above, on a construction joint 190 on the end support and accordingly grouted with concrete.

FIG. 2 is a cross section of a simplified reinforcement plan of a wall formwork system 100 in the form of a wall disc bendable girder 272 for a suspended ceiling produced using the method according to the invention, use being made of prefabricated permanent formwork systems made up of a ceiling formwork system 120 and a wall formwork system 100.

In this case, the ceiling formwork system 120 first produces a concrete ceiling 171 which, for example, can be mounted on brickwork and/or a concrete wall.

Before the concreting of the concrete ceiling 171, the ceiling formwork system 120 is provided with the required constructional and/or static reinforcement. For forming the wall disc bendable girder required in this case, there is laid, before the concreting of the concrete ceiling 171, into the ceiling formwork system 120 a statically or constructionally determined connection reinforcement 150 comprising a suspension reinforcement 252 and its securing elements 154 which are laid, for each successive meter in the ceiling formwork system 120, for engagement with the wall formwork system 100. In this case too, the securing elements 154 are suspended below the individual longitudinal bars 121 of the ceiling formwork system 120, to which they are connected. On completion of the reinforcement operations, the concrete ceiling 201 is grouted with concrete. Once the concrete has reached sufficient strength, the wall formwork system 100, which is provided at the factory with the required reinforcement mats 210 and reinforcement bars 211 for forming a wall disc bendable girder 202, is erected on a construction joint 190 and secured using suitable support devices (not shown). The portion of the suspension reinforcement 252 that protrudes from the concrete ceiling 171 is connected to the reinforcement mats 210 and/or reinforcement bars 211 by means of securing elements. The wall formwork system 100 is then grouted with concrete.

In the case of the wall formwork system 100 shown in FIGS. 1 and 2 and the ceiling formwork system 120 of the method according to the invention, an especially suitable concrete is, in particular, self-compacting concrete (SCC) on account of its advantageous properties such as demixing-free outflow of the SCC until the levels have been fully equalized, almost complete deaeration without additional compacting operations, and defect-free compacting. As a result of the omission of active compacting, the overall noise pollution on site is reduced, the laying capacity rises and fewer staff are required to lay the SCC as, on account of the self-deaeration of SCC, no one has to operate the internal vibrators and, on account of the self-levelling of SCC, in particular in the case of horizontal ceilings, no one has to level the concrete ceiling.

The invention claimed is:

1. A method for producing a wall-ceiling reinforced concrete construction, the concrete construction comprising a wall and a ceiling, the wall including concrete between first and second formwork panels of a permanent wall formwork system, and the ceiling including a finished concrete layer on a base panel of a permanent ceiling formwork system, the finished concrete layer having a projected thickness, the method comprising:

prefabricating the permanent wall formwork system, the permanent wall formwork system including the first and second formwork panels that are set apart from each other and secured to each other by coupling devices, prefabricating the permanent ceiling formwork system, the permanent ceiling formwork system including the base panel, a plurality of stirrups that are secured onto the base panel, and a plurality of individual longitudinal bars that are secured to the plurality of stirrups and are anchored by the plurality of stirrups, to the base panel side by side to extend in a distance above the base panel, so that the plurality of individual longitudinal bars lies in a lower third of said projected thickness of the finished concrete layer of the ceiling, erecting the prefabricated wall formwork system and attaching the prefabricated ceiling formwork system on an upper portion of the wall formwork system, so that the plurality of individual longitudinal bars and extends perpendicularly to the wall formwork system, thereafter inserting a first leg of an angular connection reinforcement in such a way downwards into the upper portion of the wall formwork system, that a second leg of the connection reinforcement is spaced in a distance above the plurality of individual longitudinal bars of the ceiling formwork system and in an upper region of said projected thickness of the finished concrete layer, anchoring the second leg of the connection reinforcement to the base panel of the ceiling formwork system by securing the second leg to at least one of the plurality of individual longitudinal bars, and, thereafter, grouting the ceiling and the wall with concrete.

2. The method according to claim 1, wherein the ceiling and wall are grouted with concrete in one course starting from an upper side of the ceiling formwork.

3. The method according to claim 2, wherein prefabricating and erecting the wall formwork system comprise providing that the first formwork panel is lower than the second formwork panel after erecting the wall formwork system, and attaching the ceiling formwork system on an upper portion of the wall formwork system further comprises placing the base panel of the ceiling formwork system flush onto the first formwork panel of the wall formwork system.

4. The method according to any one of claims 1 to 3, wherein the concrete is a self-compacting concrete.

* * * * *